United States Patent [19]

Meier et al.

[11] 4,396,306

[45] Aug. 2, 1983

[54] LINE SPACING MECHANISM FOR TYPEWRITERS OR LIKE MACHINES

[75] Inventors: Heinz Meier; Egon Zurawski, both of Berlin, Fed. Rep. of Germany

[73] Assignee: Triumph-Adler A.G. fur Buro -und Informationstechnik, Nuremberg, Fed. Rep. of Germany

[21] Appl. No.: 281,370

[22] Filed: Jul. 8, 1981

[30] Foreign Application Priority Data

Sep. 16, 1980 [DE] Fed. Rep. of Germany ..... 3034837

[51] Int. Cl.[3] ..... B41J 19/80

[52] U.S. Cl. ..... 400/574.1; 400/575.1; 400/575.2; 400/440.2

[58] Field of Search ..... 400/574.1, 525.1, 440.2, 400/575.2

[56] References Cited

U.S. PATENT DOCUMENTS

| | | | |
|---|---|---|---|
| 1,121,096 | 12/1914 | Hazen | 400/575.2 |
| 1,163,563 | 12/1915 | Schneeloch | 400/575.1 |
| 1,402,266 | 1/1922 | Spiro | 400/575.2 |
| 2,717,070 | 12/1953 | Letterman | 400/574.1 |
| 3,763,987 | 10/1973 | Kunst et al. | 400/574.1 |
| 3,934,696 | 1/1976 | Mueller et al. | 400/440.2 |

*Primary Examiner*—Edgar S. Burr
*Assistant Examiner*—Bradley M. Lewis
*Attorney, Agent, or Firm*—Joseph R. Spalla

[57] ABSTRACT

A line spacing mechanism having a platen, a line spacing ratchet, a line spacing lever mounting a pawl adapted to engage and to drive said ratchet upon pivoting movement of said line space lever, a setting lever for controlling the time of engagement of said pawl and ratchet and adjustable stop means for limiting driving movement of said pawl and overtravel of the platen. The mechanism includes a single detent means for detentably holding said ratchet, said setting lever and said stop means, and includes means on said setting lever operable on said detent means to release said ratchet for irregular movement.

2 Claims, 4 Drawing Figures

LINE SPACING MECHANISM FOR TYPEWRITERS OR LIKE MACHINES

This invention relates to line space mechanism for indexing a platen through selected fixed or irregular angles, and particularly to line space mechanism having a single structure for detentably holding a line space ratchet, a line setting lever and rotatably adjustable stop means for limiting line space movement.

Line spacing mechanisms serve the purpose of moving paper clamped into the paper carrier to a new writing line. To do this, a line spacing ratchet is provided which is fixed to the platen shaft and actuated by means of a line spacing pawl. The interline spacing is established by a line setter positionable to control the time of engagement of the line space pawl. In addition, provision is usually made to release a ratchet detent to allow the platen to be positioned to any angle without reference to the tooth spacing of the line spacing ratchet.

The state of the art describes a multitude of line spacing devices among which is U.S. Pat. No. 1,163,563. The known devices, however, are characterized by the use of numerous components as, for example, multiple detents which are costly to produce assemble and adjust.

In accordance with the invention a line spacing mechanism is provided which offers an economy of parts which are easy to assemble and adjust. In particular, a single spring is provided and mounted to perform all of the detent functions without the necessity for roller detents. A feature of the invention is a rotatably adjustable stop for limiting the stroke of the pawl and for preventing overtravel of the ratchet.

An object of the invention is to provide a platen indexing mechanism having a minimum of parts which are easily assembled.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
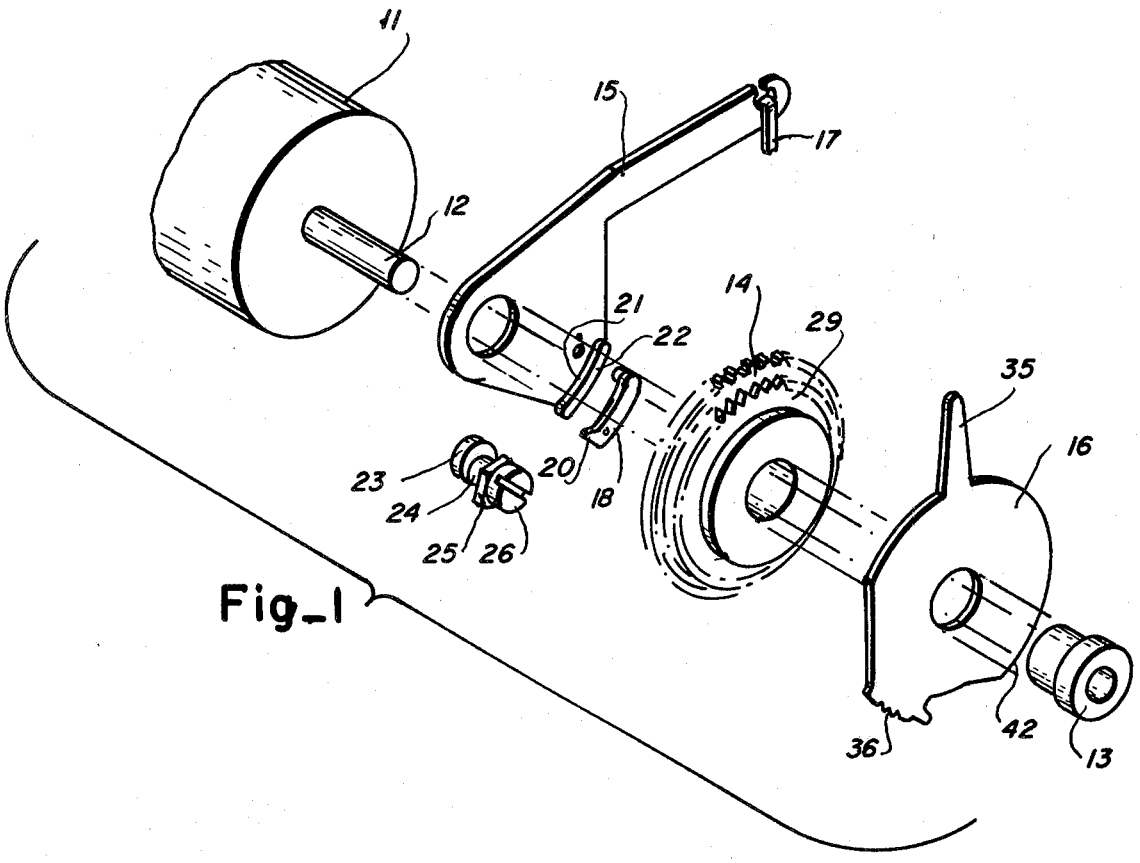
FIG. 1 is an exploded perspective view of the essential components of the invention.

Referring now to the drawings there is shown in FIG. 1 a platen 11 which has the usual platen shaft 12 fixedly supporting a bushing 13. Bushing 13 fixedly mounts a line spacing ratchet 14, and rotatably mounts a line spacing lever 15 and a line setting lever 16.

Figure 3:
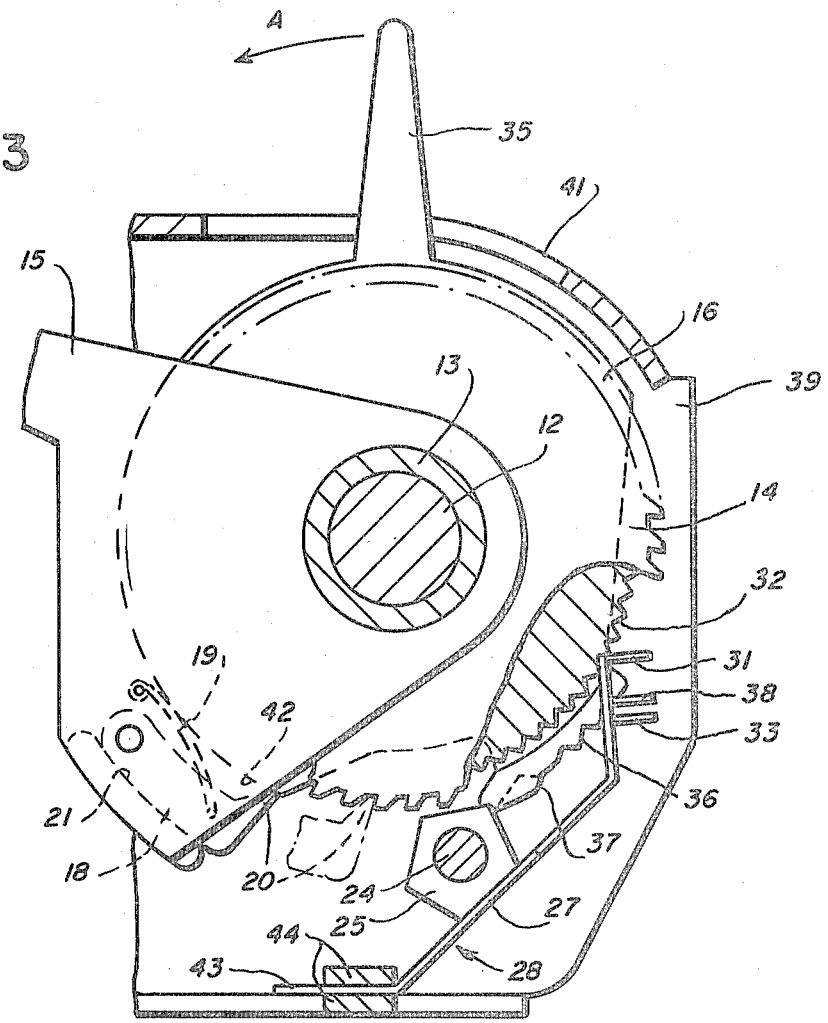
FIG. 3 is a transverse section of the line spacing device at rest with the setting lever set to maximum line space position.

A pull band 17, actuated in a conventional manner incident to a line spacing function, is connected to rotate the line spacing lever 15 counter to a suitable biasing spring (not shown). Pivoted on the line spacing lever 15 is a line spacing pawl 18. The pawl 18 is biased as by a spring 19 (FIG. 3) connected at one end to the pawl and anchored at its other end to the spacing lever 15. The spring 19 urges the pawl 18 toward the line spacing ratchet 14 for engagement of its tooth 20 with the teeth thereof. As shown in FIG. 1 and 3, the line spacing pawl 18 is supported by a bearing surface 21 on an abutment 22 formed on the line spacing lever 15 radially outwardly of the pawl 18.

Figure 2:
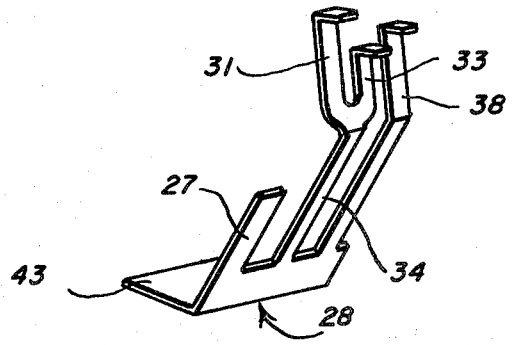
FIG. 2 is a perspective view of a detent spring according to the invention.

Pawl stop means comprising an eccentric bolt 23 with an eccentric pin 24, a polygonal section 25 and a slotted head 26 is provided to adjustably limit the travel of the spacing pawl 18 upon a pivoting motion of the line spacing lever 15. It may be seen from FIG. 3 that the eccentric pin 24 is rotatably adjustable so that the stroke of the line spacing pawl 18 is limited. With reference to FIGS. 1 and 2 a tongue 27 of a multi-tongue or multi-arm detent spring generally designated by reference numeral 28 engages a surface of the polygonal section 25 to detentably hold the pawl stop means in a selected rotational position, with the eccentric 24 defining the limit of travel of the pawl 18.

In the embodiment shown, a toothed wheel 29 is located adjacent the line spacing ratchet 14. The toothed wheel 29 and ratchet 14 may be produced as one piece or separately. In the latter case, they will be joined together. The toothed wheel 29 has symmetrical teeth 32 whereas the line spacing ratchet 14 has saw teeth. Another tongue 31 of detent spring 28 interacts with the teeth 32 of the toothed wheel 29 to detentably hold the line spacing ratchet 14 in a manner yet to be described. Tongue 31 and another tongue 33, branch off from a common arm 34 as shown in FIG. 2.

Figure 4:
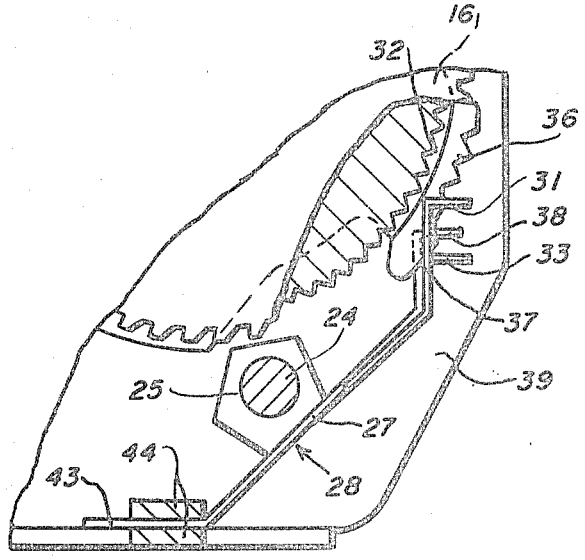
FIG. 4 is a partial elevational view similar to FIG. 3 showing elements positioned for irregular line spacing.

As shown in FIGS. 1 and 3 the line setting lever 16 is provided with a handle 35, detent teeth 36 and a protrusion 37. The detent teeth 36 interact with another tongue 38 of detent spring 28 to detentably hold the line setting lever 16 at the position selected. In an irregular line space or ratchet release position of the line setting lever 16, the protrusion 37 interacts with and pushes tongue 33 of spring 28 outwardly as shown in FIG. 4. This movement carries tongue 31 away from teeth 32 out the ratchet detenting position shown in FIG. 3 releasing the ratchet and platen for rotational movement through any angle as by knobs secured to the ends of platen shaft 12.

The entire line spacing device with the platen shaft 12 is mounted in the usual manner in the paper carrier of the typewriter. FIGS. 3 and 4 only show one sidewall 39 thereof, which may at the same time be the outside trim of the paper carrier. It has a slot 41 through which the handle 35 of the line setting lever 16 protrudes.

The line spacing device according to the invention is shown in FIG. 3 in normal position and set for maximum line spacing. As shown the tooth 20 of the line spacing pawl 18 rests on the circular periphery 42 of the line setting lever 16. Accordingly, the line spacing pawl 18 is held out of engagement from the saw teeth of the line spacing ratchet 14. As will be understood, if the line setting lever 16 is moved in the direction of arrow A by means of the handle 35, its periphery 42 moves counterclockwise and thus determines, incident to motion of the line spacing lever 15, the time of engagement of the tooth 20 of the spacing pawl 18 with a saw tooth of the line spacing ratchet 14. Thus a single-space or double-space, incident to a line space operation for example can be predetermined. FIG. 3 illustrates a spacing movement in progress wherein the spacing pawl 18 is depicted in dash-dotted lines. The pawl 18 engages the line spacing ratchet 14 due to the action of spring 19 after the pawl tooth 20 has cleared the periphery 42 of the line setting lever 16 and is allowed to pivot toward the teeth of ratchet 14. The motion of the spacing pawl 18 and with it of the line spacing ratchet 14 as well as that of the platen 11 is limited in that the spacing pawl 18 strikes the eccentric stop pin 24, and thus overtravel of the ratchet 14 is prevented. Upon the return of the line spacing lever 15 into its starting position the spacing pawl 18 glides over the oblique edges of the saw teeth of the line spacing ratchet 14 until it rests again on the periphery 42 of the line setting lever 16. The respective rotary position of the line spacing ratchet 14 and platen 11 is detentably secured by the interaction of the spring tongue 31 with the teeth 32 on the toothed wheel 29 secured to the line spacing ratchet 14.

As hereinbefore noted, the respective position of the line setting lever 16 is locked by means of the detent teeth 36 and the spring tongue 38. In accordance with the invention, the line setting lever 16 also acts at the same time to release the platen 11 for irregular line feed when moved into a ratchet detent release position wherein, as shown in FIG. 4, the protrusion 37 pushes against the spring tongue 33 and, inasmuch as the tongue 33 is disposed on a common arm 34 with tongue 31, the tongue 31 is caused to be moved out of the teeth 32 to a ratchet release position. Accordingly, the platen 11 can be turned manually to any angular position, such as by platen turning knobs, not shown. In the ratchet detent release position, the spring tongue 38 continues to engage the detent teeth 36, on the line setting lever 16, thus, to hold it in the FIG. 4 position as the platen 11 is rotated relative thereto.

It is evident from the description and the drawing that a single detent spring 28 suffices if the line spacing ratchet 14, the line spacing lever 15, and the line setting lever 16 are appropriately disposed in relation to the eccentric pin 24 and if the tongues 27, 31, 33 and 38 are appropriately designed. The spring 28 is very easily produced as a stamping, and lends itself to easy assembly simply by pushing its angled-off section 43 into a clamping device 44 on the paper carrier 39.

The invention claimed is:

1. Line spacing mechanism comprising a frame, a platen having a shaft rotatably supported in said frame, line space ratchet means including a ratchet detent wheel fixed to said shaft, pawl means pivotally supported on said line space lever and biased to engage and drive said line space ratchet means to rotatably index said platen through a predetermined angle on operation of said line space lever, line setting means rotatably mounted on said shaft adjustably positionable to control the time of engagement of said pawl means with said line space ratchet means thereby to determine said predetermined angle, rotatably adjustable limit stop means on said frame for adjustably limiting driving movement of said pawl means and for preventing overtravel of said line space ratchet means, a multifunction detent comprising a single multi-armed resilient part secured to said frame, said part arms normally engaging and detentably holding said ratchet detent wheel, said line setting means and said limit stop means, respectively, and means for disengaging the part arm in engagement with said ratchet detent wheel in response to rotational movement of said line setting means to an incremental feed position.

2. Line spacing mechanism as recited in claim 1, said means for disengaging comprising a protrusion on said line setting means, and an offset on said part arm normally in engagement with said ratchet detent wheel positioned to be driven by said protrusion.

* * * * *